US007852143B2

(12) United States Patent
Koifman et al.

(10) Patent No.: US 7,852,143 B2
(45) Date of Patent: Dec. 14, 2010

(54) METHOD FOR PROVIDING A VERY LOW REFERENCE CURRENT

(75) Inventors: Vladimir Koifman, Rishon Lezion (IL); Noam Eshel, Pardesiyya (IL); Zeituni Golan, Kfar Saba (IL)

(73) Assignee: Advasense Technologies Ltd., Ra'Anana (IL)

( * ) Notice: Subject to any disclaimer, the term of this patent is extended or adjusted under 35 U.S.C. 154(b) by 137 days.

(21) Appl. No.: 12/361,739

(22) Filed: Jan. 29, 2009

(65) Prior Publication Data

US 2010/0188132 A1 Jul. 29, 2010

(51) Int. Cl.
*G05F 1/10* (2006.01)
*G05F 3/02* (2006.01)

(52) U.S. Cl. ..... 327/538; 327/539; 327/540; 327/541

(58) Field of Classification Search ..... 327/530, 327/538–543, 546; 323/312–317
See application file for complete search history.

(56) References Cited

U.S. PATENT DOCUMENTS 5,889,428 A * 3/1999 Young ..... 327/536
2005/0242799 A1* 11/2005 Erdelyi et al. ..... 323/312
2010/0128154 A1* 5/2010 Xu et al. ..... 348/301

* cited by examiner

*Primary Examiner*—Lincoln Donovan
*Assistant Examiner*—Brandon S Cole
(74) *Attorney, Agent, or Firm*—Reches Patents

(57) ABSTRACT

A system that includes: multiple transistors that comprise a first transistor that is maintained in a weak inversion state; wherein sources of the multiple transistors are coupled to a low current source; wherein drains of the multiple transistors are coupled to a voltage supply source; a first amplifier that has a positive input, negative input and an output; wherein the positive input receives an input voltage; wherein the negative input is coupled to a source of the first transistor; wherein the output is coupled to a gate of the first transistor and to a multiplication and subtracting circuit; a multiplication and subtraction circuit that is coupled to the first amplifier and outputs an output signal that equals a difference between the input voltage and a product of a current reduction variable and a voltage reduction signal; wherein the voltage reduction signal is associated with a current reduction factor; wherein the output signal is provided to a second transistor that is maintained in weak inversion; and wherein the second transistor outputs, in response to a reception of the output signal, a current that is responsive to the pixel output signal, is proportional to the low current and is inversely proportional to the current reduction variable and the current reduction factor.

23 Claims, 5 Drawing Sheets

| |
|---|
| Multiplying a voltage reduction signal that is proportional to an absolute temperature of the multiplication and subtraction circuit. 621 |
| Outputting, by a first circuit of the multiplication and subtraction circuit, during a first phase, an intermediate signal of a first value. 622 |
| Outputting, during a second phase, an intermediate signal of a second value; wherein a difference between the first and second values equals the product of the current reduction factor and the voltage reduction signal. 623 |
| Providing to the first circuit, during the first phase, a first input voltage. 624 |
| Receiving, by the first circuit and during the second phase, a second input voltage; wherein a difference between the first and second input voltages equals the voltage reduction signal. 625<br>Generating, by the first circuit, an intermediate current of a first value during the first phase. 626<br>Generating, during the second phase, an intermediate current of a second value; wherein a difference between the first and second values of the intermediate current is responsive to a difference between the first and second input voltages. 627 |
| Generating a reference current by a current source of the first circuit; wherein the first circuit further includes a current mirror, a first resistor and a second resistor. 628 |
| Mirroring, during the first phase and by the current mirror, the reference current to provide an intermediate current of a first value that flows through the second resistor. 629<br>mirroring, during the second phase and by the current mirror, a sum of the reference current and a first resistor current to provide an intermediate current of a second value; wherein the first resistor current is proportional to the difference between the first and second voltages; and wherein a ratio between resistances of the second and first resistors equals the current reduction variable. 630 |
| providing a first circuit that includes an input node, a second switch connected between the input node and a positive input of a second amplifier, a first capacitors that is connected to the positive input of the second amplifier; a first resistor connected between the input node and a negative node of the second amplifier, a fifth current source connected to an input of a current mirror; a second resistor connected between the ground and output of the current mirror; wherein the output of the current mirror provides an output node of the first circuit. 631 |
| Closing the second switch during the first phase and opening the second switch during the second phase. 632 |
| Receiving, by the second circuit, the intermediate signal from the first circuit. 633<br>Outputting, by the second circuit and during the second phase, an output signal that substantially equals a difference between the input voltage and the product of the current reduction variable and the voltage reduction signal. 624 |
| providing a second circuit that includes a third switch that is connected between the first input of the multiplication and subtraction circuit and between an intermediate node; a fourth switch that is connected between the intermediate node and an output node of the second circuit; a sixth current source that is connected to the output node of the second circuit and to a drain of a seventh transistor; a fifth switch that is connected between the drain and a source of the seventh transistor; a second capacitor that is connected between the intermediate node and the gate of the seventh transistor; and a third capacitor that is connected between the gate of the seventh transistor and an output node of the first circuit. 635 |
| Closing the third and fifth switches during the first phase. 636 |
| Opening the third and fifth switches and closing the fourth switch to start the second phase. 637<br>Converting, by the second circuit, an increment in a voltage level of the gate of the seventh transistor introduced between the first and second phases to a decrement in an output voltage of the second circuit. 638 |

620

FIG. 5

METHOD FOR PROVIDING A VERY LOW REFERENCE CURRENT

FIELD OF THE INVENTION

The invention relates to methods for providing a very low reference current.

BACKGROUND OF THE INVENTION

Multiple analog circuit, digital circuits and hybrid circuits require low and even very low reference currents. A non-limiting example of such a circuit can be a camera pixel that operates at a current mode.

Highly stable reference current circuits are relatively expensive.

There is a growing need to provide stable low reference current circuits.

SUMMARY OF THE INVENTION

A system including: multiple transistors that include a first transistor that is maintained in a weak inversion state; wherein sources of the multiple transistors are connected to a low current source; wherein drains of the multiple transistors are connected to a voltage supply source; a first amplifier that has a positive input, negative input and an output; wherein the positive input receives an input voltage; wherein the negative input is connected to a source of the first transistor; wherein the output is connected to a gate of the first transistor and to a multiplication and subtracting circuit; a multiplication and subtraction circuit that is connected to the first amplifier and outputs an output signal that equals a difference between the input voltage and a product of a current reduction variable and a voltage reduction signal; wherein the voltage reduction signal is associated with a current reduction factor; wherein the output signal is provided to a second transistor that is maintained in weak inversion; wherein the second transistor outputs, in response to a reception of the output signal, a current that is responsive to the pixel output signal, is proportional to the low current and is inversely proportional to the current reduction variable and the current reduction factor.

A method including: draining from a first transistor a first reference current that equals a fraction of a first reference current while providing to the first transistor, from a first amplifier, a first amplifier output signal that substantially equals an input voltage; wherein the first reference current is connected to multiple (K) transistors that are connected in parallel to each other and are connected to a current source that provides the current to the transistor; wherein the multiple transistors includes the first transistor; wherein a gate of the first transistor receives from a first amplifier a first amplifier output signal that substantially equals an input voltage; generating, by a multiplication and subtraction circuit, a multiplication and subtraction circuit output signal that substantially equals a difference between the first amplifier output signal and a product of a current reduction variable and a voltage reduction signal; supplying the multiplication and subtraction output signal to a second transistor that is substantially equal to the first transistor and is maintained in a weak inversion; so that the second transistor drains a current that is substantially equal to the first reference current after being divided by product of the current reduction variable and K.

BRIEF DESCRIPTION OF THE DRAWINGS

The present invention will be understood and appreciated more fully from the following detailed description taken in conjunction with the drawings in which:

FIG. 4 and FIG. 5 illustrate a method according to an embodiment of the invention.

DETAILED DESCRIPTION OF THE DRAWINGS

Figure 1:
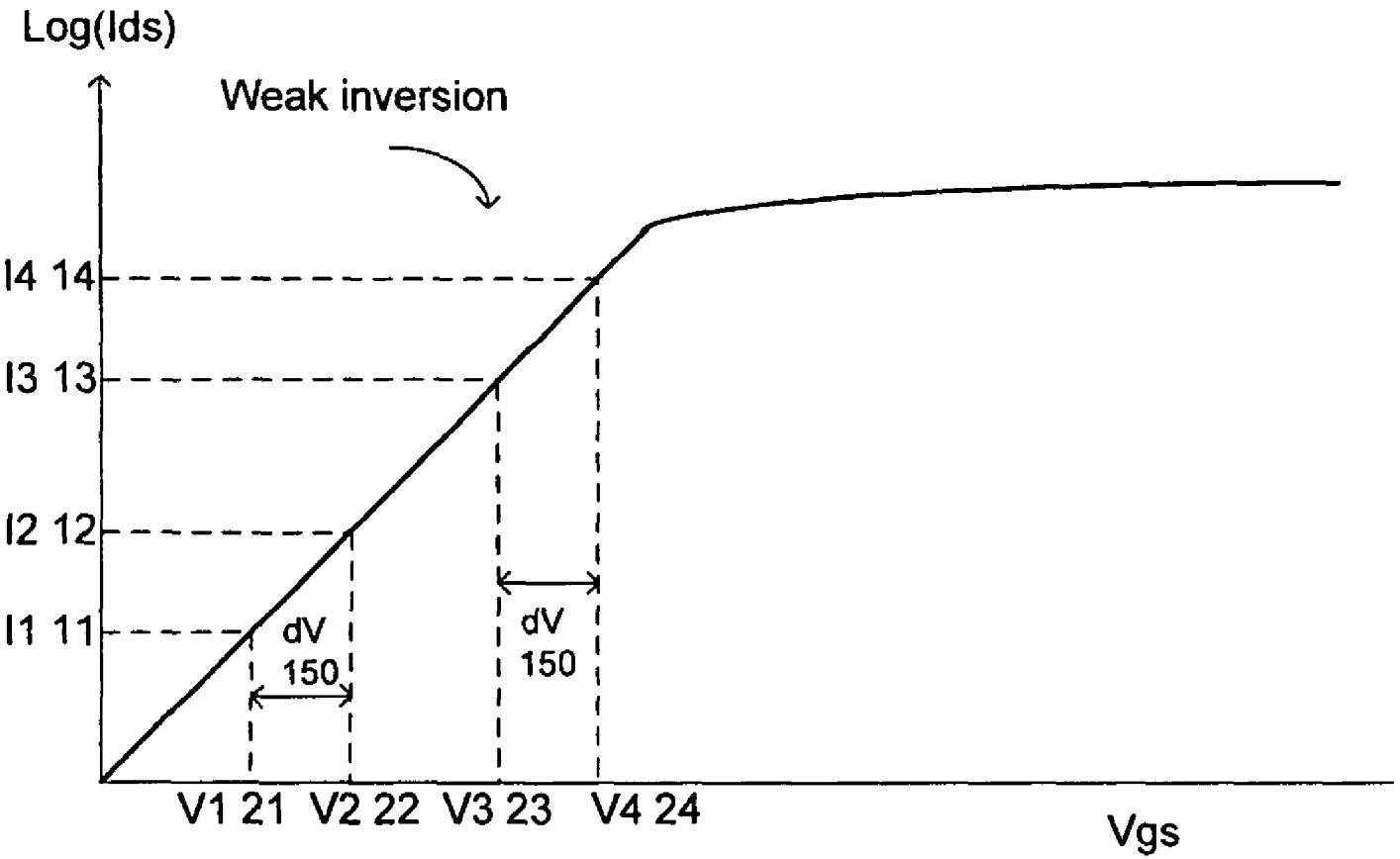
FIG. 1 illustrates a voltage current characteristic of a transistor.

FIG. 1 illustrates a voltage current characteristic of a transistor. When the transistor is in a weak inversion state there is a linear relationship between the gate source voltage (Vgs) of the transistor and a logarithm ($Log_{10}$) of its drain source current (Log(Ids)). Curve 33 illustrates this linear relationship.

Assuming that when the source gate voltage (Vgs) of the transistor equals V1 21 then the logarithm of its drain source current (Log (Ids)) equals I1 11, when the source gate voltage (Vgs) of the transistor equals V2 22 then the logarithm of its drain source current (Log (Ids)) equals I2 12, when the source gate voltage (Vgs) of the transistor equals V3 23 then the logarithm of its drain source current (Log (Ids)) equals I3 13, and when the source gate voltage (Vgs) of the transistor equals V4 24 then the logarithm of its drain source current (Log (Ids)) equals I4 14. The linear relationships between these values is represents by dl=k*dV. Wherein dl is the current reduction factor and it equals I1/I2=I3/I4, dV is the voltage reduction signal and it equals (V2−V1) or (V4−V3).

Accordingly, if at a certain Vgs (denoted Vgs(a)) a transistor (that is at a weak inversion state) generates (or drains) a certain current (Ids(a)) then in order to generate a current that is a fraction of that certain current this transistor (or an equivalent transistor) should be provided with a Vgs (denoted Vgs (b)) that equals Vgs(a)−dV*N, wherein N is a positive number that is also referred to as a current reduction variable.

Vgs can be set by providing a certain voltage at the gate of the transistor.

Figure 2:
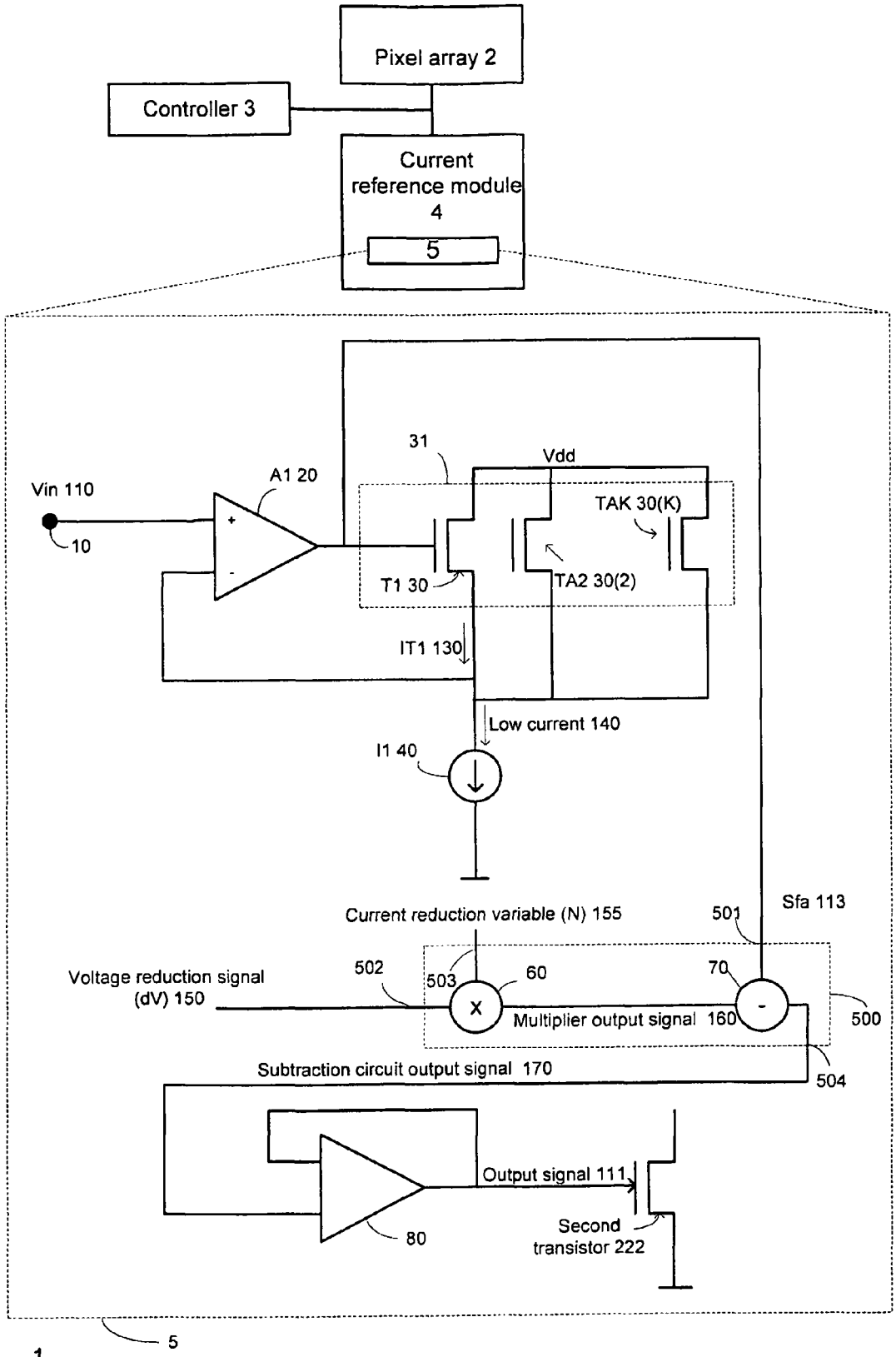
FIG. 2 illustrates a system according to an embodiment of the invention.
Figure 3:
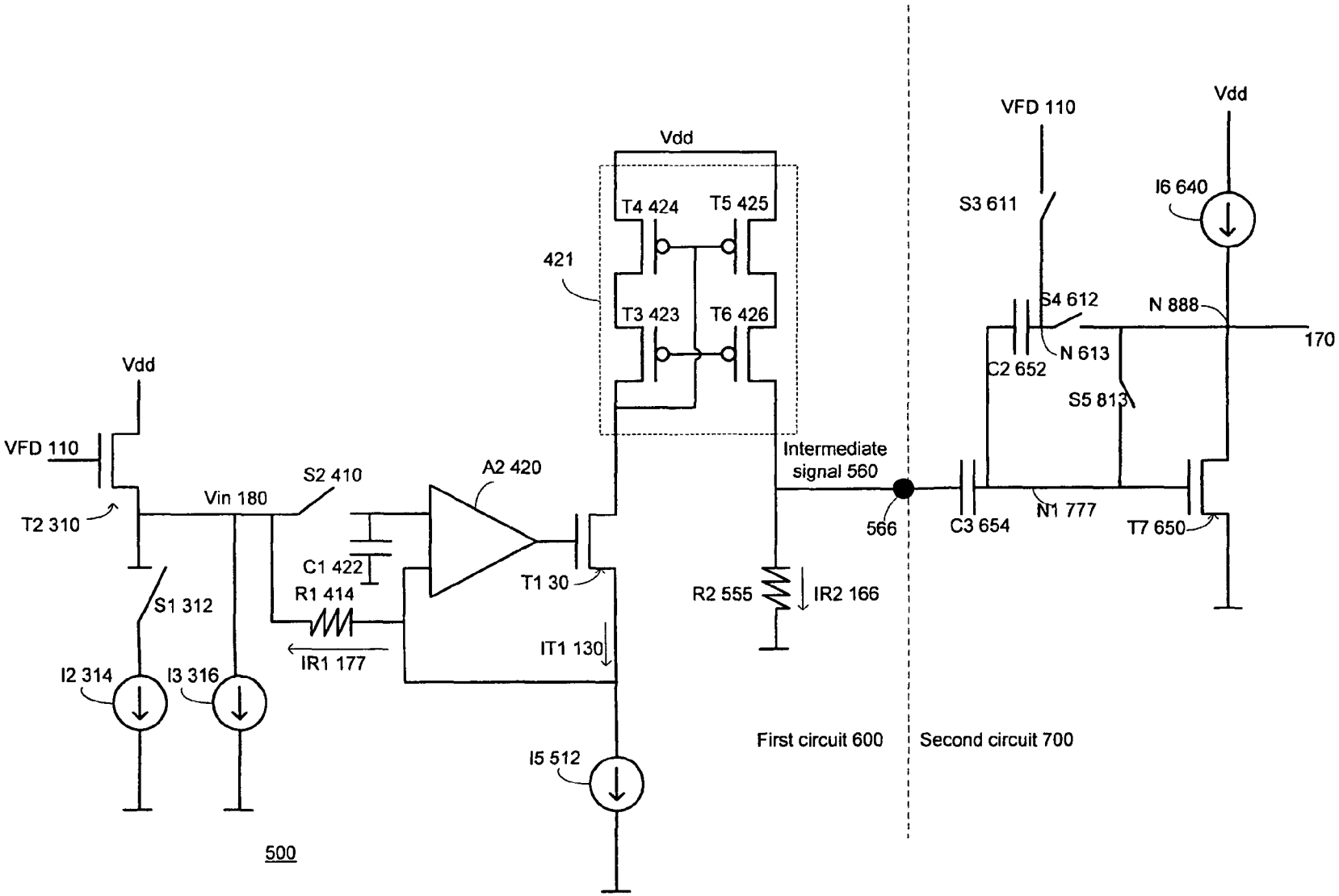
FIG. 3 illustrates a multiplying and subtracting circuit according to an embodiment of the invention.

FIG. 2 illustrates system 1 according to an embodiment of the invention. FIG. 3 illustrates a multiplication and subtraction circuit 500 of portion 2 according to an embodiment of the invention.

The system can be an integrated circuit, a camera, a light sensor, a mobile device and the like. Conveniently, the very low reference current is provided to one or more CMOP pixels of a camera.

FIG. 1 illustrates system 1 as including a pixel array 2 that is connected to a controller 3 and a current reference module 4. Current reference module 4 can provide very low reference current to one or more pixels of pixel array 2.

Current reference module 4 can include one or more (usually much more than one) circuits such as reference current circuit 5.

Reference current circuit 5 can include a second transistor (such as T2 222) or can be connected to a second transistor that when receiving output signal 111 will drain a current that equals (Low Current/(K*N)).

Reference current circuit 5 can receive an input voltage Vin that reflects the gate voltage of a transistor of a pixel when that transistor drains a current that equals Low current. It can output a voltage signal (Vout) that will cause such a transistor to drain a current that equals (Low Current/(K*N)). Vin can be, for example, an output signal of a pixel and can have a value that equals a floating diffusion voltage (Vfd) of a floating diffusion node of a pixel such as a four pixel transistor that illustrated in U.S. patent application Ser. No. 11/752,973, filing date Aug. 13, 2007 titled "METHODS FOR READING A PIXEL AND FOR WRITING TO A PIXEL AND A DEVICE HAVING PIXEL READING CAPABILITIES AND PIXEL WRITING CAPABILITIES" which is incorporated herein by reference.

Reference current circuit 5 includes input node 10, first amplifier A1 20, an array of K transistors (including transistors such as T1 30, TA2 30(2) and (K-2) other transistors such as TAK 30(K)), first current source I1 40, multiplication and subtraction circuit 500 and third amplifier A3 80.

Low current 140 is drained by first current source I1 40 and is divided by a dual phase process.

During the first phase low current 140 is drained from K transistors that are connected in parallel to each other, thus the current drained from a single transistor (such as first transistor T1 30) equals (low current)/K.

During a second phase output signal 111 is generated and sent to second transistor T2 222. The value of output signal 111 is set so that it will cause second transistor T2 222 to output a fraction (1/N) of (low current/K). Thus, second transistor the drain source current Ids of second transistor T2 222 will equal (low current/(K×dl×N). Wherein N is a current reduction factor and dl is associated with a voltage reduction signal. Second transistor T2 222 is maintained at a weak inversion mode.

Input node 10 receives Vin 100 and provides it to a positive input of first amplifier A1 20. A first transistor T1 30 is connected in parallel to a plurality (K-1) of transistors such as transistors TA2 30(2)-TAK 30(K) that form an array of transistors 31. These transistors are also referred to as multiple transistors.

First current source I1 40 is connected to the sources of each of these multiple transistors.

First current source I1 40 drains low current 140. The parallel connection of K transistors divides the current that is drained from each transistor to (low current)/K. Thus, the drain source (Ids) current of first transistor T1 30 equals (low current)/K. The gate of first transistor T1 30 receives a voltage that substantially equals Vin 110.

The negative input of first amplifier A1 20 is connected to a source of first transistor T1 30. The output of first amplifier A1 20 is connected to a gate of first transistor T1 30 and to multiplication and subtracting circuit 500.

Multiplication and subtraction circuit 500 is connected to the output of first amplifier A1 20 and outputs a first amplifier output signal (Sfa) 113 that equals a difference between the input voltage (Vin 110) and a product of a current reduction variable (N 155) and a voltage reduction signal (dV150). Voltage reduction signal dV 150 is associated with a current reduction factor dl, as illustrated in FIG. 1.

Output signal (Vout) 111 is provided to a second transistor 222 that is maintained in weak inversion. Second transistor 222 drains, in response to a reception of output signal 111, a current (It2 224) that is responsive to pixel output signal Vin 110, is proportional to low current 140 and is inversely proportional to current reduction variable 155 and current reduction factor dl.

According to an embodiment of the invention voltage reduction signal dV 150 is proportional to an absolute temperature of system 8. It is also referred to as Vptat.

A simplified illustration of multiplication and subtraction circuit 500 is illustrated in FIG. 2. It includes multiplier 60, subtracting circuit 70, as well as first till third inputs 501-503 and output 504. First input 501 is connected to an output of first amplifier A1 20 to receive first amplifier output signal (Sfa) 113. Second input 502 receives current reduction variable (N) 155 and third input 503 receives voltage reduction signal dV 150.

Multiplier 60 multiplies voltage reduction signal dV 150 by a current reduction variable N 155 to provide a multiplier output signal 160 that has a value of N*dV. Subtracting circuit 70 subtracts the multiplier output signal 160 from first amplifier output signal (Sfa) 113 that substantially equals Vin 110. Sfa 113 is supplied by first amplifier A1 20. Subtracting circuit 70 outputs a multiplication and subtraction circuit output signal 170 that substantially equals Vin−(N*dV). Multiplication and subtraction circuit output signal 170 is provided to third amplifier 80 to provide an output signal (Vout) 111 that substantially equals Vin−(N*dV). In a sense third amplifier 80 acts as a buffer. While a positive input of third amplifier A3 80 is connected to an output of third amplifier A3 80 the negative input of third amplifier A3 80 receives multiplication and subtraction circuit output signal 170.

Multiplication and subtraction circuit 500 includes first circuit 600 that outputs, during a first phase, an intermediate signal 560 of a first value and outputs, during a second phase, an intermediate signal 560 of a second value. A difference between the first and second values equals the product of the current reduction factor and the voltage reduction signal.

Conveniently, first circuit 500 receives, during the first phase, input voltage Vin 180 of a first value (also referred to as first input voltage). It receives, during the second phase, input signal 180 of a second value (also referred to as second input voltage). Wherein a difference between the first and second input voltages equals voltage reduction signal dV 150.

First circuit 600 is fed by a variable current source VI 333 that generates an intermediate current of a first value during the first phase and generates an intermediate current of a second value during the second phase. A difference between the first and second values of the intermediate current is responsive to a difference between the first value (V1) and the second value (V2) of input voltage 180.

First circuit 600 includes first current source I5 512, current mirror 421, first resistor R1 414 and second resistor R2 555. Fifth current source I5 512 generates fifth reference current Iref5 513. During the first phase current mirror 412 mirrors fifth reference current Iref5 513 to provide an intermediate current IR2 166 of a first value that flows through second resistor R2 555.

During a first phase second switch S2 410 is closed and V2 180 (having first value V1) charges first capacitor 422 that is connected between an input of second amplifier A2 420 and the ground. R1 is virtually shorted (assuming that the voltage level at both inputs of second amplifier A2 420 is equal to each other. Thus—during the first phase the current that flows through first resistor (IR1 177) is zero.

First resistor R1 414 receives input voltage Vin 180 on one end and receives (when switch S2 410 is open) the voltage of first capacitor C1 422.

During the second phase current switch S2 410 is opened so that a voltage potential of (V2−V1) develops across first resistor R1 414 and a current of IR1=(V2−V1)/R1 flows through first resistor R1 414.

Current mirror 412 mirrors a sum of the fifth reference current (I5 513) and a first resistor current (IR1 177) to provide an intermediate current IR2 166 of a second value. During the second phase first resistor current IR1 177 is proportional to the difference between the first and second voltages; and wherein a ratio between resistances of the second and first resistors equals the current reduction variable.

Intermediate signal 560 is provided to second circuit 700. Second circuit 700 is configured to receive intermediate signal 560 from first circuit 600 and to output, during the second phase, a multiplication and subtraction circuit output signal 170 that equals the difference between the input voltage and the product of the current reduction variable and the voltage reduction signal.

Second circuit 700 includes third switch S3 611, fourth switch S4 612, fifth switch S5 813, second capacitor C2 652, third capacitor C3 654, sixth current source 16 640, and seventh transistor T7 650.

Third switch S3 611 is connected between first input 501 of multiplication and subtraction circuit 501 (to receive Vin' 111) and between intermediate node 613. Fourth switch s4 612 is connected between intermediate node 613 and output node 888 of second circuit 700. Sixth current source is connected to output node 888 and to a drain of seventh transistor T7 650. Fifth switch S5 813 is connected between the drain and a source of seventh transistor T7 650. Second capacitor C2 652 is connected between intermediate node 613 and the gate of seventh transistor. Third capacitor C3 654 is connected between the gate of the seventh transistor T7 650 and output node 566 of first circuit 600.

Third and fifth switches (S3 and S5) are closed during the first phase and are opened during the second phase.

Second circuit 700 converts an increment in a voltage level of the gate of seventh transistor T7 650 introduced between the first and second phases to a decrement in multiplication and subtraction circuit output signal 170.

During a first phase third and fifth switches (S3 and S5) are closed and C2 652 and C3 654 are set to initial values. Then S3 611 and S5 813 are opened and at this moment S4 612 is closed and output 170 equals Vdd while C2 and C3 maintain their initial values (obtained during the first phase. During the second phase the intermediate signal 560 from first circuit 600 changes to (V2−V1)*R2/R1 and this affects second circuit 700 to output an signal that equals {VFD−(V2−V1)*R2/R1}.

Figure 4:
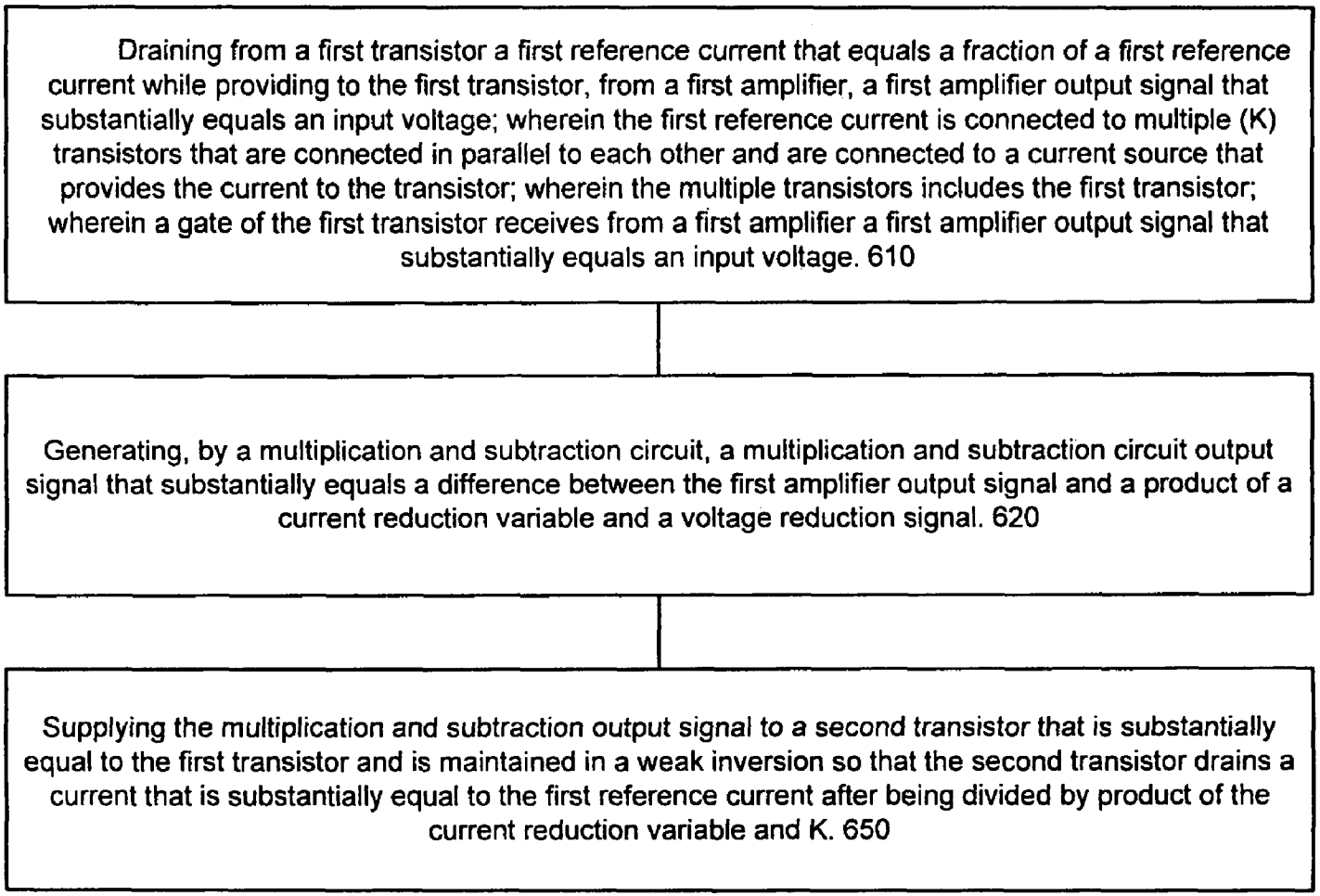

FIGS. 4 and 5 illustrate method 600 according to an embodiment of the invention.

Method 600 can be implemented by system 5 of FIGS. 2-3.

Method 600 starts by stage 610 of draining from a first transistor a first reference current that equals a fraction of a first reference current while providing to the first transistor, from a first amplifier, a first amplifier output signal that substantially equals an input voltage; wherein the first reference current is connected to multiple (K) transistors that are connected in parallel to each other and are connected to a current source that provides the current to the transistor; wherein the multiple transistors includes the first transistor; wherein a gate of the first transistor receives from a first amplifier a first amplifier output signal that substantially equals an input voltage.

Stage 610 is followed by stage 620 of generating, by a multiplication and subtraction circuit, a multiplication and subtraction circuit output signal that substantially equals a difference between the first amplifier output signal and a product of a current reduction variable and a voltage reduction signal.

Stage 620 is followed by stage 650 of supplying the multiplication and subtraction output signal to a second transistor that is substantially equal to the first transistor and is maintained in a weak inversion so that the second transistor drains a current that is substantially equal to the first reference current after being divided by product of the current reduction variable and K.

Stage 620 can include stage 621 of multiplying a voltage reduction signal that is proportional to an absolute temperature of the multiplication and subtraction circuit.

Stage 620 can include: (i) stage 622 of outputting, by a first circuit of the multiplication and subtraction circuit, during a first phase, an intermediate signal of a first value; and (ii) stage 623 of outputting, during a second phase, an intermediate signal of a second value; wherein a difference between the first and second values equals the product of the current reduction factor and the voltage reduction signal.

Stage 620 can include: (i) stage 624 of providing to the first circuit, during the first phase, a first input voltage; and (ii) stage 625 of receiving, by the first circuit and during the second phase, a second input voltage; wherein a difference between the first and second input voltages equals the voltage reduction signal.

Stage 620 can include: (i) stage 626 of generating, by the first circuit an intermediate current of a first value during the first phase; and (ii) stage 627 of generating, during the second phase, an intermediate current of a second value; wherein a difference between the first and second values of the intermediate current is responsive to a difference between the first and second input voltages.

Stage 620 can include: (i) stage 628 of generating a reference current by a current source of the first circuit; wherein the first circuit further includes a current mirror, a first resistor and a second resistor; (ii) stage 629 of mirroring, during the first phase and by the current mirror, the reference current to provide an intermediate current of a first value that flows through the second resistor; and (iii) stage 630 of mirroring, during the second phase and by the current mirror, a sum of the reference current and a first resistor current to provide an intermediate current of a second value; wherein the first resistor current is proportional to the difference between the first and second voltages; and wherein a ratio between resistances of the second and first resistors equals the current reduction variable.

Stage 620 can include: (i) stage 631 of providing a first circuit that includes an input node, a second switch connected between the input node and a positive input of a second amplifier, a first capacitors that is connected to the positive input of the second amplifier; a first resistor connected between the input node and a negative node of the second amplifier, a fifth current source connected to an input of a current mirror; a second resistor connected between the ground and output of the current mirror; wherein the output of the current mirror provides an output node of the first circuit; and (ii) stage 632 of closing the second switch during the first phase and opening the second switch during the second phase.

Stage 620 can include: (i) stage 633 of receiving, by the second circuit, the intermediate signal from the first circuit; and (ii) stage 634 of outputting, by the second circuit and during the second phase, an output signal that substantially equals a difference between the input voltage and the product of the current reduction variable and the voltage reduction signal.

Stage 620 can also include: (i) stage 635 of providing a second circuit that includes a third switch that is connected between the first input of the multiplication and subtraction circuit and between an intermediate node; a fourth switch that is connected between the intermediate node and an output node of the second circuit; a sixth current source that is connected to the output node of the second circuit and to a drain of a seventh transistor; a fifth switch that is connected between the drain and a source of the seventh transistor; a second capacitor that is connected between the intermediate node and the gate of the seventh transistor; and a third capacitor that is connected between the gate of the seventh transistor and an output node of the first circuit; (ii) stage 636 of closing the third and fifth switches during the first phase; and (iii) stage 637 of opening the third and fifth switches and closing the fourth switch to start the second phase.

Stage 620 can include stage 638 of converting, by the second circuit, an increment in a voltage level of the gate of the seventh transistor introduced between the first and second phases to a decrement in an output voltage of the second circuit.

Stage 610 can include receiving the input signal from a pixel that is configured to sense light and to generate a pixel output voltage.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

We claim:

1. A system comprising:

multiple transistors that comprise a first transistor that is maintained in a weak inversion state; wherein sources of the multiple transistors are coupled to a low current source; wherein drains of the multiple transistors are coupled to a voltage supply source;

a first amplifier that has a positive input, negative input and an output; wherein the positive input receives an input voltage; wherein the negative input is coupled to a source of the first transistor; wherein the output is coupled to a gate of the first transistor and to a multiplication and subtracting circuit;

a multiplication and subtraction circuit that is coupled to the first amplifier and outputs an output signal that equals a difference between the input voltage and a product of a current reduction variable and a voltage reduction signal; wherein the voltage reduction signal is associated with a current reduction factor;

wherein the output signal is provided to a second transistor that is maintained in weak inversion;

wherein the second transistor outputs, in response to a reception of the output signal, a current that is responsive to the pixel output signal, is proportional to the low current and is inversely proportional to the current reduction variable and the current reduction factor.

2. The system according to claim 1 wherein the voltage reduction signal is proportional to an absolute temperature of the system.

3. The system according to claim 1 wherein the multiplication and subtraction circuit that comprises a first input, a second input, a third input and an output;

wherein the first input is coupled to the output of the first amplifier to receive the input voltage;

wherein the second input receives the current reduction variable;

wherein the third input receives the voltage reduction signal;

wherein the output signal of the multiplication and subtraction circuit equals a difference between the input voltage and a product of the current reduction factor and the voltage reduction signal.

4. The system according to claim 1 wherein the multiplication and subtraction circuit comprises a first circuit that outputs, during a first phase, an intermediate signal of a first value and outputs, during a second phase, an intermediate signal of a second value; wherein a difference between the first and second values equals the product of the current reduction factor and the voltage reduction signal.

5. The system according to claim 4 wherein the first circuit receives, during the first phase, a first input voltage; and receives, during the second phase, a second input voltage; wherein a difference between the first and second input voltages equals the voltage reduction signal.

6. The system according to claim 5 wherein the first circuit generates an intermediate current of a first value during the first phase and generates an intermediate current of a second value during the second phase; wherein a difference between the first and second values of the intermediate current is responsive to a difference between the first and second input voltages.

7. The system according to claim 6 wherein the first circuit comprises a current source, a current mirror, a first resistor and a second resistor; wherein the current source generates a reference current;

wherein during the first phase the current mirror mirrors the reference current to provide an intermediate current of a first value that flows through the second resistor; and wherein during the second phase the current mirror mirrors a sum of the reference current and a first resistor current to provide an intermediate current of a second value; wherein the first resistor current is proportional to the difference between the first and second voltages; and wherein a ratio between resistances of the second and first resistors equals the current reduction variable.

8. The system according to claim 4 wherein the first circuit comprises an input node, a second switch coupled between the input node and a positive input of a second amplifier, a first capacitors that is coupled to the positive input of the second amplifier; a first resistor coupled between the input node and a negative node of the second amplifier, a fifth current source coupled to an input of a current mirror; a second resistor coupled between the ground and output of the current mirror; wherein the output of the current mirror provides an output node of the first circuit; wherein the second switch is closed during the first phase and opened during the second phase.

9. The system according to claim 4 comprising a second circuit configured to receive the intermediate signal from the first circuit and to output, during the second phase, the output signal that equals the difference between the input voltage and the product of the current reduction variable and the voltage reduction signal.

10. The system according to claim 9 wherein the second circuit comprises a third switch that is coupled between the first input of the multiplication and subtraction circuit and between an intermediate node; a fourth switch that is coupled between the intermediate node and an output node of the second circuit; a sixth current source that is coupled to the output node of the second circuit and to a drain of a seventh transistor; a fifth switch that is coupled between the drain and a source of the seventh transistor; a second capacitor that is coupled between the intermediate node and the gate of the seventh transistor; and a third capacitor that is coupled between the gate of the seventh transistor and an output node of the first circuit; wherein the third and fifth switches are closed during the first phase and are opened during the second phase; wherein the fourth switch is closed during the second phase.

11. The system according to claim 10 wherein the second circuit converts an increment in a voltage level of the gate of the seventh transistor introduced between the first and second phases to a decrement in an output voltage of the second circuit.

12. The system according to claim 1 further comprising a pixel configured to sense light and to generate a pixel output voltage; wherein the positive input of the first amplifier receives an input signal that equals the pixel output voltage.

13. A method comprising:

draining from a first transistor a first reference current that equals a fraction of a first reference current while providing to the first transistor, from a first amplifier, a first amplifier output signal that substantially equals an input voltage; wherein the first reference current is coupled to multiple (K) transistors that are coupled in parallel to each other and are coupled to a current source that provides the current to the transistor; wherein the multiple transistors comprises the first transistor; wherein a gate of the first transistor receives from a first amplifier a first amplifier output signal that substantially equals an input voltage;

generating, by a multiplication and subtraction circuit, a multiplication and subtraction circuit output signal that substantially equals a difference between the first amplifier output signal and a product of a current reduction variable and a voltage reduction signal;

supplying the multiplication and subtraction output signal to a second transistor that is substantially equal to the first transistor and is maintained in a weak inversion; so that the second transistor drains a current that is substantially equal to the first reference current after being divided by product of the current reduction variable and K.

14. The method according to claim 13 comprising multiplying a voltage reduction signal that is proportional to an absolute temperature of the multiplication and subtraction circuit.

15. The method according to claim 13 comprising:

outputting, by a first circuit of the multiplication and subtraction circuit, during a first phase, an intermediate signal of a first value; and outputting, during a second phase, an intermediate signal of a second value;

wherein a difference between the first and second values equals the product of the current reduction factor and the voltage reduction signal.

16. The method according to claim 15 comprising:

providing to the first circuit, during the first phase, a first input voltage; and receiving, by the first circuit and during the second phase, a second input voltage;

wherein a difference between the first and second input voltages equals the voltage reduction signal.

17. The method according to claim 16 comprising:

generating, by the first circuit, an intermediate current of a first value during the first phase; and generating, during the second phase, an intermediate current of a second value; wherein a difference between the first and second values of the intermediate current is responsive to a difference between the first and second input voltages.

18. The method according to claim 17 comprising:

generating a reference current by a current source of the first circuit; wherein the first circuit further comprises a current mirror, a first resistor and a second resistor;

mirroring, during the first phase and by the current mirror, the reference current to provide an intermediate current of a first value that flows through the second resistor; and mirroring, during the second phase and by the current mirror, a sum of the reference current and a first resistor current to provide an intermediate current of a second value; wherein the first resistor current is proportional to the difference between the first and second voltages; and wherein a ratio between resistances of the second and first resistors equals the current reduction variable.

19. The method according to claim 18 comprising:

providing a first circuit that comprises an input node, a second switch coupled between the input node and a positive input of a second amplifier, a first capacitors that is coupled to the positive input of the second amplifier; a first resistor coupled between the input node and a negative node of the second amplifier, a fifth current source coupled to an input of a current mirror; a second resistor coupled between the ground and output of the current mirror; wherein the output of the current mirror provides an output node of the first circuit; and closing the second switch during the first phase and opening the second switch during the second phase.

20. The method according to claim 18 comprising receiving, by the second circuit, the intermediate signal from the first circuit and outputting, by the second circuit and during the second phase, an output signal that substantially equals a difference between the input voltage and the product of the current reduction variable and the voltage reduction signal.

21. The method according to claim 20 comprising:

providing a second circuit that comprises a third switch that is coupled between the first input of the multiplication and subtraction circuit and between an intermediate node; a fourth switch that is coupled between the intermediate node and an output node of the second circuit; a sixth current source that is coupled to the output node of the second circuit and to a drain of a seventh transistor; a fifth switch that is coupled between the drain and a source of the seventh transistor; a second capacitor that is coupled between the intermediate node and the gate of the seventh transistor; and a third capacitor that is coupled between the gate of the seventh transistor and an output node of the first circuit;

closing the third and fifth switches during the first phase; and opening the third and fifth switches during the second phase; wherein the fourth switch is open during the second phase.

22. The method according to claim 21 comprising converting, by the second circuit, an increment in a voltage level of the gate of the seventh transistor introduced between the first and second phases to a decrement in an output voltage of the second circuit.

23. The method according to claim 15 further comprising receiving the input signal from a pixel that is configured to sense light and to generate a pixel output voltage.

* * * * *